United States Patent [19]

Novikov et al.

[11] Patent Number: 5,052,887

[45] Date of Patent: Oct. 1, 1991

[54] TURBOMOLECULAR VACUUM PUMP

[76] Inventors: Nikolai M. Novikov, ulitsa Molodezhnaya, 2, kv. 16, Vladimirskaya oblast, Suzdalsky raion selo Novoe; Vladimir I. Vikhrev, Szudalsky prospekt, 3, kv. 52; Valery B. Sholokhov, ulitsa Gorkogo, 75, kv. 55, both of Vladimir, all of U.S.S.R.

[21] Appl. No.: 427,097

[22] PCT Filed: Feb. 26, 1988

[86] PCT No.: PCT/SU88/00047

§ 371 Date: Oct. 5, 1989

§ 102(e) Date: Oct. 5, 1989

[87] PCT Pub. No.: WO89/08192

PCT Pub. Date: Sep. 8, 1989

[51] Int. Cl.[5] ..... F01D 1/36

[52] U.S. Cl. ..... 415/90

[58] Field of Search ..... 415/90

[56] References Cited

U.S. PATENT DOCUMENTS

| | | | |
|---|---|---|---|
| 3,748,055 | 7/1973 | Becker | 415/90 |
| 3,826,588 | 7/1974 | Frank | 415/90 |
| 4,111,595 | 9/1978 | Becker et al. | 415/90 |
| 4,732,529 | 3/1988 | Narita et al. | 415/90 |
| 4,826,393 | 5/1989 | Miki | 415/90 |
| 4,893,985 | 1/1990 | Holss | 415/90 |

FOREIGN PATENT DOCUMENTS

| | | | |
|---|---|---|---|
| 0081690 | 6/1983 | European Pat. Off. . | |
| 2035063 | 1/1972 | Fed. Rep. of Germany | 415/90 |
| 2255618 | 12/1982 | Fed. Rep. of Germany . | |
| 3613344 | 10/1987 | Fed. Rep. of Germany . | |
| 2244370 | 4/1975 | France . | |
| 159695 | 7/1988 | Japan | 415/90 |
| 335443 | 4/1972 | U.S.S.R. . | |
| 715821 | 2/1980 | U.S.S.R. | 415/90 |

*Primary Examiner*—John T. Kwon

*Attorney, Agent, or Firm*—Lilling & Lilling

[57] ABSTRACT

A turbomolecular vacuum pump has a hollow stator accommodating a rotor having bladed wheels with bladed disks interposed therebetween. Flat blades of each bladed wheel are spaced circumferentially at the surface of its hub and are inclined to planes perpendicular to the axis of rotation of the rotor toward the side of its rotation. Each blade is disposed so that lines of intersection of its planes with the planes perpendicular to the axis of rotation of the rotor are at an angle to the radii of the wheel hub at a point of intersection of these lines with hub circles, and are directed with respect to the bladed wheel at the gas pressure side to the direction of rotation of the rotor, and with respect to the bladed wheel at the gas suction side to a side opposite to the direction of rotation of the rotor.

1 Claim, 4 Drawing Sheets

TURBOMOLECULAR VACUUM PUMP

BACKGROUND OF THE INVENTION

1. Field of the Invention

This invention relates generally to rotary gas suction pumps, particularly to axial flow molecular vacuum pumps intended for generating high vacuum, and more specifically concerns a turbomolecular vacuum pump.

2. Description of the Related Art

Modern advances in science and technology necessitate high demand for a range of types and sizes of molecular vacuum pumps of various suction performance, viz., rapidity and gas compression ratio, determining the size of major working parts of such pumps.

Depending on the pumping characteristics, there are known molecular vacuum pumps having only a molecular pumping stage, and turbomolecular or combination vacuum pumps having an additional turbomolecular gas pumping stage comprising an assembly of rotor and stator arranged axially with the rotor and stator of the molecular gas pumping stage at the gas suction side. Secured alternately at the rotor and stator of the turbomolecular gas pumping stage are bladed wheels and bladed disks having blades thereof positioned at an angle to each other. The blades of the bladed wheels are inclined to planes perpendicular to the axis of rotation of the rotor, whereas the flow sections of interblade passages reduce from the bladed wheel at the gas suction side to the bladed wheel at the gas pressure side. These turbomolecular vacuum pumps are characterized by sufficiently high rapidity, although they are overcomplicated structurally.

The operating principle of a turbomolecular vacuum pump resides in that molecules of gas collide with blades of the rotating bladed wheel and receive an impulse which adds a tangential velocity component in the direction of rotation of the bladed wheel to the inherent thermal velocity of the molecules. Multiple collisions of the gas molecules with the rotor blades turn random motion of the molecules into ordered motion in a direction from the gas suction side toward the gas pressure side resulting in evacuation of the gas molecules.

In the flow of molecules the average free travel of a gas molecule is greater than the distance between the adjacent blades, and therefore the molecules tend to collide with the rotor blades more often than with one another.

Efficiency in operation and rapidity of the turbomolecular vacuum pump depends on what part of gas molecules is conveyed through the bladed wheels and bladed disks from the gas suction side to the gas pressure side.

There is known a turbomolecular vacuum pump comprising a hollow stator the axial interior hole of which accommodates a rotor with at least two bladed wheels having bladed disks interposed therebetween and secured on the stator, the flat blades of these bladed disks being arranged at an angle to the flat blades of the bladed wheels of the rotor spaced equidistantly about the circle of a hub of the corresponding bladed wheel so that the flow sections of passages between the planes of the adjacent blades facing each other reduce from the bladed wheel at the gas suction side to the bladed wheel at the gas pressure side, the planes thereof being inclined to planes perpendicular to the axis of rotation of the rotor in the direction of its rotation.

The blades of the bladed wheels are disposed at the hubs so that lines of intersection of the planes of each of the blades with planes perpendicular to the axis of rotation of the rotor extend radially about the circumference of the hub.

Of decisive importance for the suction characteristics of the turbomolecular vacuum pump is the dependence between the suction rapidity and gas compression ratio. This dependence is determined by the geometry of the bladed wheels and bladed disks, as well as the size of the major structural elements of the pump.

In the known turbomolecular vacuum pump molecules following the mirror reflection law and moving in planes tangent to circles coaxial with the circle of the hub and intersecting the planes of the blades are caused to obtain during collision therewith a tangential velocity component, whereby the molecules of gas partially return to the enclosure being evacuated and partially collide again in the same planes obtaining the same impulse. This, however, affects the rapidity of the turbomolecular pump. In addition, a backflow of dispersed molecules of gas in the clearance between the rotor and stator takes place.

SUMMARY OF THE INVENTION

The present invention aims at providing a turbomolecular vacuum pump with the planes of blades of the bladed wheels so arranged as to ensure a higher suction performance without increasing its dimensions.

The aims of the invention are attained by a turbomolecular vacuum pump comprising a hollow stator having an axial hole accommodating a rotor with at least two bladed wheels with bladed disks interposed therebetween and secured on the stator, flat blades of the bladed disks being arranged at an angle to the flat blades of the bladed wheels, the flat blades of the bladed wheels being spaced about the circumference of a hub of the corresponding bladed wheel so that the flow sections of passages between planes of the adjacent blades facing each other reduce from the bladed wheel at a gas suction side to the bladed wheel at a gas pressure side, the planes of the blades of the bladed wheels being inclined to planes perpendicular to the axis of rotation of the rotor toward the side of its rotation. According to the invention, each blade of at least one of the bladed wheels is arranged so that lines of intersection of the planes of each blade of at least one of the bladed wheels with planes perpendicular to the axis of rotation of the rotor rest at an angle to radii of the wheel hub at a point of intersection of these lines with hub circles, and are directed with respect to at least one bladed wheel at the gas pressure side to the direction of rotation of the rotor and with respect to at least one bladed wheel at the gas suction side to a side opposite to the direction of rotation of the rotor.

At the same angle of inclination of the planes of blades of all the bladed wheels to planes perpendicular to the axis of rotation of the rotor and equal number of blades at all the bladed wheels, the rotor has a plane perpendicular to its axis of rotation. Preferably to one side of this plane, an increase in the distance from this plane results in growing angles of inclination in the lines of intersection between the planes of the blades, whereas to different sides of the rotor plane the lines of intersection of the blade planes are inclined to different sides relative to the direction of rotation of the rotor, each bladed wheel being offset relative to the other bladed wheels to an angle ensuring that for each blade of each bladed wheel there is one blade of each other bladed wheel with which its planes facing one side lie in one common plane.

The aforedescribed structural arrangement of the turbomolecular vacuum pump improves its suction performance. The pump is more rapid in action because the linear velocities of gas molecules are increased as the latter collide with the surfaces of the blades of the bladed wheel at the gas suction side, and, as apart from the tangential velocity component, they obtain a radial velocity component.

Another advantageous feature is increased gas compression ratio thanks to a higher tendency of gas molecules to move from the gas suction side to the gas pressure side and to reduced backflow of dispersed molecules, since as the molecules collide with the blades of the bladed wheel at the gas pressure side they receive a radial component in a direction from the free end of the blade to the center of the bladed wheel.

In practice, the proposed turbomolecular vacuum pump is at least 20% more rapid, and produces a compression at least five times higher than prior art turbomolecular pumps of the same size.

BRIEF DESCRIPTION OF THE DRAWINGS

The invention will now be described in greater detail with reference to a specific embodiment thereof taken in conjunction with the accompanying drawings, in which.

DESCRIPTION OF THE PREFERRED EMBODIMENT

Figure 1:
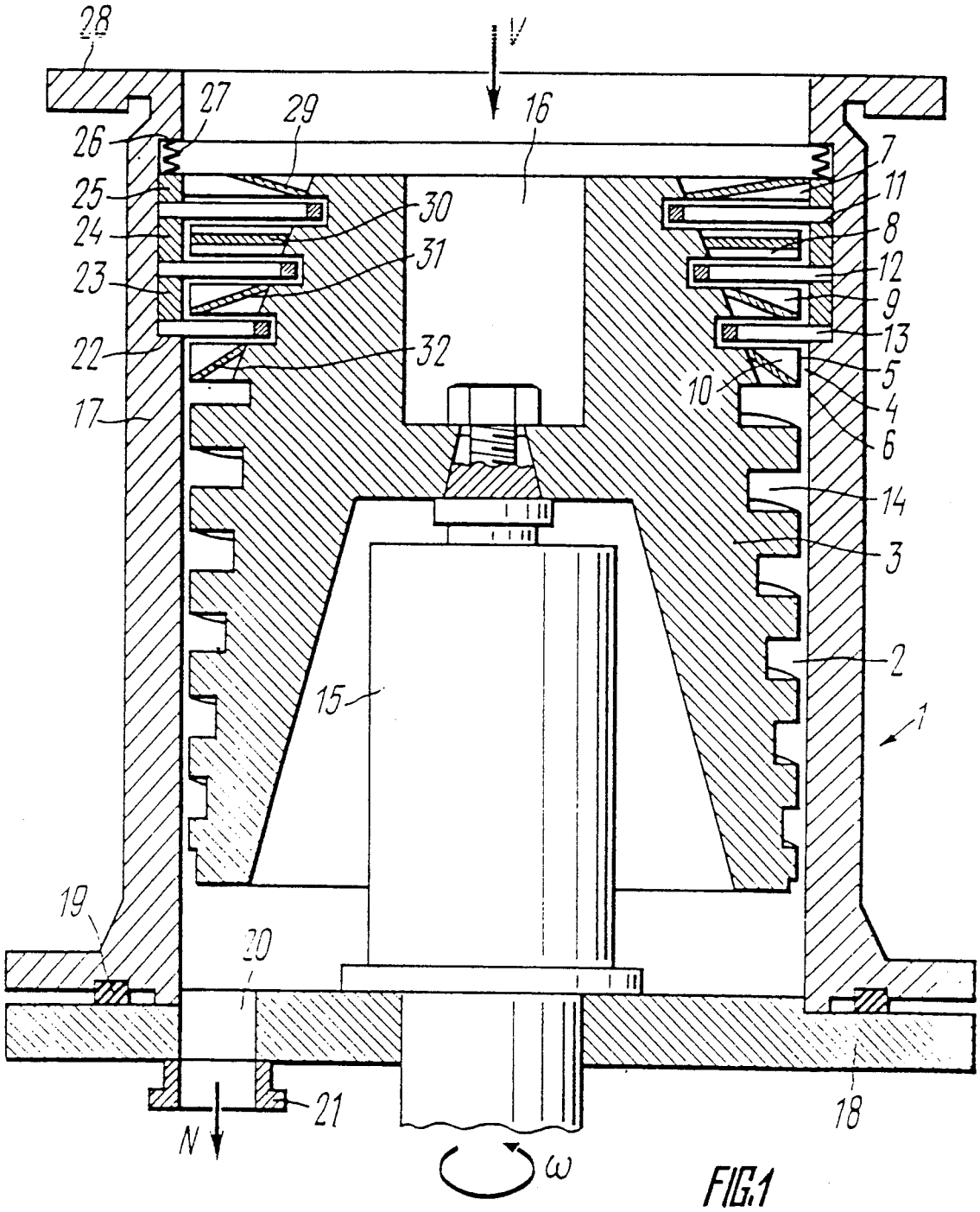
FIG. 1 is a general longitudinal sectional view of a turbomolecular vacuum pump according to the invention.

A turbomolecular vacuum pump comprises a hollow stator 1 (FIG. 1) an axial hole 2 of which accommodates a rotor 3. A clearance 4 between an outer cylindrical surface 5 of the rotor 3 and inner cylindrical surface 6 of the stator 1 is very small, normally amounting from 0.15 to 0.3 mm to provide a relatively high resistance to the backflow of gas and thereby preventing the travel of gas from the gas pressure side N (as shown by the arrow) to the gas suction side V (also shown by the arrow).

The proposed turbomolecular vacuum pump is a combination vacuum pump comprising turbomolecular and molecular gas pumping stages.

The turbomolecular gas pumping stage includes at least two bladed wheels, and a bladed disk interposed therebetween. The number of bladed wheels can be other than two, as is in the other prior art turbomolecular vacuum pumps. Particularly, the number of bladed wheels can vary from two to twenty, or can be even more, depending on the geometrical parameters of the structural parts of the pump, more specifically on the flow section of interblade passages of the bladed wheels and on the suction characteristics of the turbomolecular vacuum pump.

In a modification of the proposed turbomolecular vacuum pump shown in FIG. 1, there are four bladed wheels 7, 8, 9, 10 and three bladed disks 11, 12, 13.

The molecular gas pumping stage has the form of grooves 14 of a multistart square thread made at the outer cylindrical surface 5 of the rotor 3 defining with the inner cylindrical surface 6 of the stator 1 gas suction passages having a flow section gradually reducing in a direction from the gas suction side V to the gas pressure side N. The rotor 3 is mounted on a shaft 15 and is secured at one end thereof by a screw 16. The other end of the shaft 15 is connected to an electric motor (not shown). The stator 1 includes a housing 17 secured by a threaded connection on a flange 18. In order to pressureseal the interior of the stator 1, a sealing ring 19 is provided between the flange 18 and lower end face of the housing 17. The flanges 18 has a hole 20 with a pipe butt 21 secured on the flange 18 coaxially with the hole 20 at the gas pressure side N to be in turn connected to a pipeline (not shown) for forevacuum gas pumping.

The bladed disks 11, 12, 13 are secured at the inner surface of the housing 17 so that their free ends are clamped between a shoulder 22 of the housing 17 of the stator 1 and ring elements 23, 24, 25. Compression springs 27 are provided between the ring 25 and shoulder 26 of the housing 17 of the stator 1. A flange 28 is further provided at the housing 17 at the gas suction side V for connecting to a chamber (not shown) of a production unit where vacuum is to be generated.

Flat blades 29, 30, 31, 32 of the first, second, third and fourth bladed wheels 7, 8, 9, 10, respectively, at the gas suction side V are inclined at acute angles $\alpha_1$ (FIG. 2), $\alpha_2$, $\alpha_3$, $\alpha_4$ to planes perpendicular to the axis 0 of rotation of the rotor 3 toward the direction of rotation of the rotor 3 (direction of rotation is indicated in FIGS. 1, 2, 3, 4, 5 and 6 by the arrow $\omega$).

Angle $\alpha_1$ is the angle between the plane of the blade 29 and end face of the first bladed wheel 7 at the gas suction side V facing the gas suction side V.

Angle $\alpha_2$ is the angle between the plane of the blade 30 and end face of the second bladed wheel 8 at the gas suction side V.

Angle $\alpha_3$ is the angle between the plane of the blade 31 and end face of the third bladed wheel 9 at the gas suction side V.

Angle $\alpha_4$ is the angle between the plane of the blade 32 and end face of the fourth bladed wheel 10 at the gas suction side V or the first bladed wheel 10 at the gas pressure side N.

The angles $\alpha_1$, $\alpha_2$, $\alpha_3$, $\alpha_4$ can range from 10° to 60°, as in other known constructions of turbomolecular vacuum pumps. These angles $\alpha_1$, $\alpha_2$, $\alpha_3$, $\alpha_4$, can be the same for all the bladed wheels 7, 8, 9, 10, or they can be different. If $\alpha_1 \neq \alpha_2 \neq \alpha_3 \neq \alpha_4$ with respect to all the bladed wheels 7, 8, 9, 10, this angle gradually reduces from the bladed wheel 7 at the gas suction side V to the bladed wheel 10 at the gas pressure side N, i.e., $\alpha_1 > \alpha_2$.

$>\alpha_3>\alpha_4$. When these angles are similar, that is $\alpha_1=\alpha_2=\alpha_3=\alpha_4$, then, as is known, efficient gas pumping necessitates an increase in the number of blades 29, 30, 31, 32 from the first bladed wheel at the gas suction side V to the bladed wheel 10 at the gas pressure side N, or an increase in the width of the bladed wheels 7, 8, 9, 10, or both.

The number of blades 29, 30, 31, 32 on each of the bladed wheels 7, 8, 9, 10 can be the same or different, as the case with other known constructions of turbomolecular vacuum pumps.

In the herein described construction of a turbomolecular vacuum pump the number of blades 29, 30, 31, 32 is the same for all the bladed wheels 7, 8, 9, 10, viz., thirty six. The angles $\alpha_1$, $\alpha_2$, $\alpha_3$, $\alpha_4$ of inclination of the corresponding blades 29, 30, 31, 32 are also identical and equal 45°, i.e., $\alpha_1=\alpha_2=\alpha_3=\alpha_4=45°$.

The flat blades 29 (FIG. 3) of the first bladed wheel at the gas suction side V are spaced equidistantly about the radius $R_1$ of a hub 33 to form passages 34 between the planes facing each other. The flat blades 30 (FIG. 4) of the second bladed wheel 8 at the gas suction side V are spaced equidistantly about the radius $R_2$ of a hub 35 to form passages 36. The flat blades 31 (FIG. 5) of the third bladed wheel 9 at the gas suction side V are spaced equidistantly about the radius $R_3$ of a hub to form passages 38. The flat blades 32 (FIG. 6) of the fourth bladed wheel 10 at the gas suction side V are spaced equidistantly about the radius $R_4$ of a hub 39 to form interblade passages 40.

Figure 7:
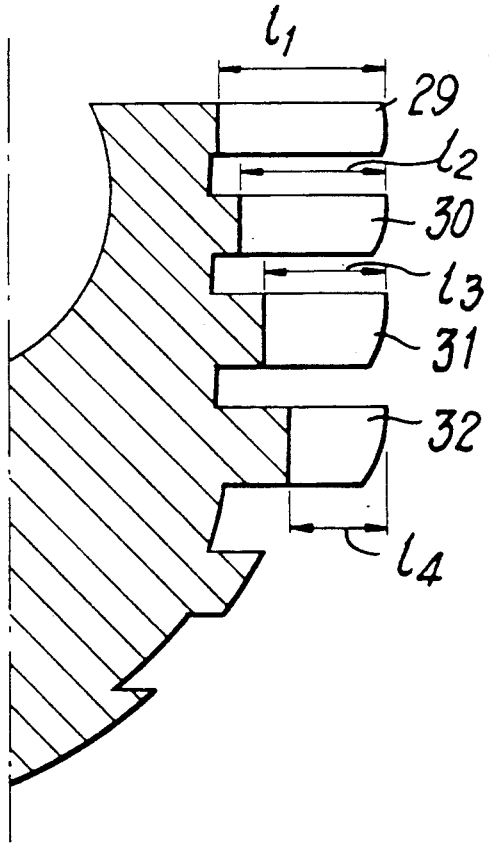
FIG. 7 is a section taken along the line VII—VII in FIG. 2.

The width $a_1$ (FIG. 2), $a_2$, $a_3$, $a_4$ of the respective bladed wheels 7, 8, 9, 10 increases from the first bladed wheel 7 at the gas suction side V to the bladed wheel 10 at the gas pressure side N, i.e., $a_1<a_2<a_3<a_4$. Flow sections of the passages 34 (FIG. 3), 36 (FIG. 4), 38 (FIG. 5), 40 (FIG. 6) reduce from the bladed wheel 7 at the gas suction side V to the bladed wheel 10 at the gas pressure side N by virtue of reduction in the length of the blades 30, 31, 32, i.e., $l_1$ (FIG. 7)$>l_2>l_3>l_4$, where $l_1$ is the length of blades 29 of the bladed wheel 7;

$l_2$ is the length of blades 30 of the bladed wheel 8;

$l_3$ is the length of blades 31 of the bladed wheel 9; and $l_4$ is the length of blades 32 of the bladed wheel 10.

The radii $R_2$, $R_3$, $R_4$ of the hubs 35, 37, 39 of the bladed wheels 8, 9, 10 are increased, i.e., $R_1<R_2<R_3<R_4$.

Each blade of at least one of the bladed wheels is disposed so that lines of intersection of its planes with the planes perpendicular to the axis of rotation of the rotor are at an angle to the radii of its hub drawn to the points of intersection of these lines with the circles of the hubs, and directed, with respect to at least one bladed wheel at the gas pressure side, toward the side of rotation of the rotor, and with respect to at least one bladed wheel at the gas suction side—to the opposite direction.

In the herein described embodiment of the proposed turbomolecular vacuum pump each blade 29 (FIG. 3) of the first bladed wheel 7 at the gas suction side V is arranged so that the line "m" of intersection of one of its planes with the end face of bladed wheel 7 facing the gas suction side V is at an acute angle $\beta_1=30°$ to the radius $R_1$ of the circle of the hub 33 drawn to the point $S_1$ of intersection of the line "m" with the circle of the hub 33, and is inclined to a side opposite to the direction $\omega$ of rotation of the rotor 3.

Figure 8:
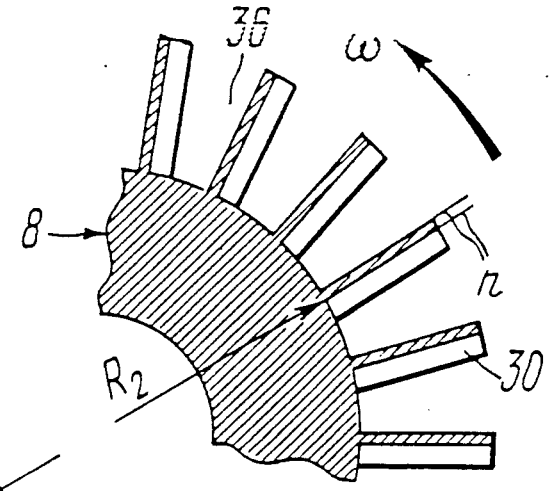
FIG. 8 is a section taken along the line VIII—VIII in FIG. 2.
Figure 4:
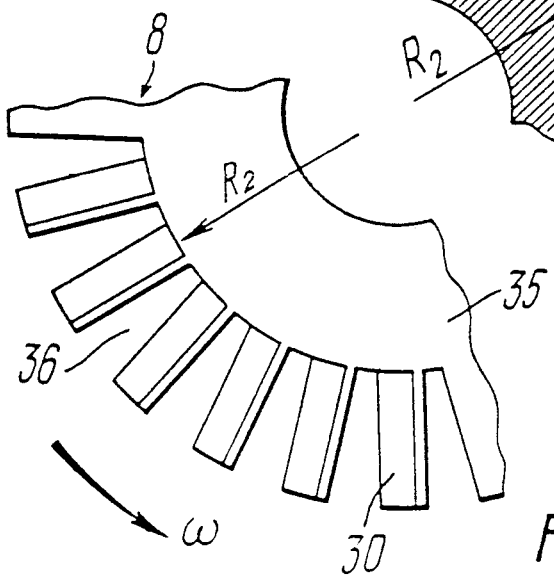
FIG. 4 is a view taken along the arrow A in FIG. 2 illustrating a portion of the second bladed wheel at the gas suction side.
Figure 5:
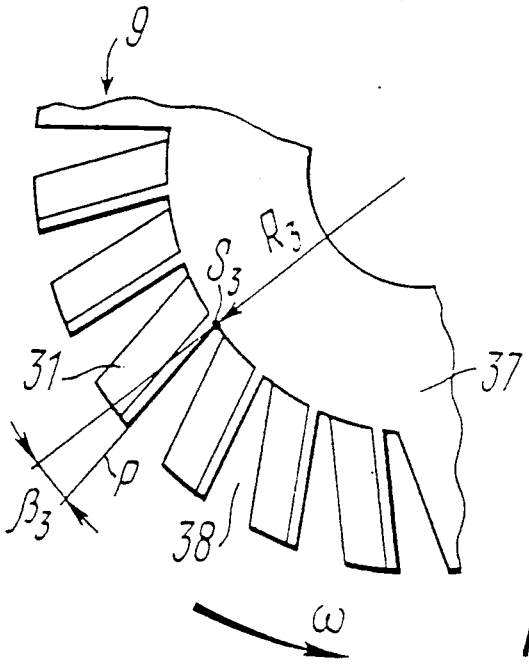
FIG. 5 is a view taken along the arrow A in FIG. 2 showing a portion of the third bladed wheel at the gas suction side.
Figure 6:
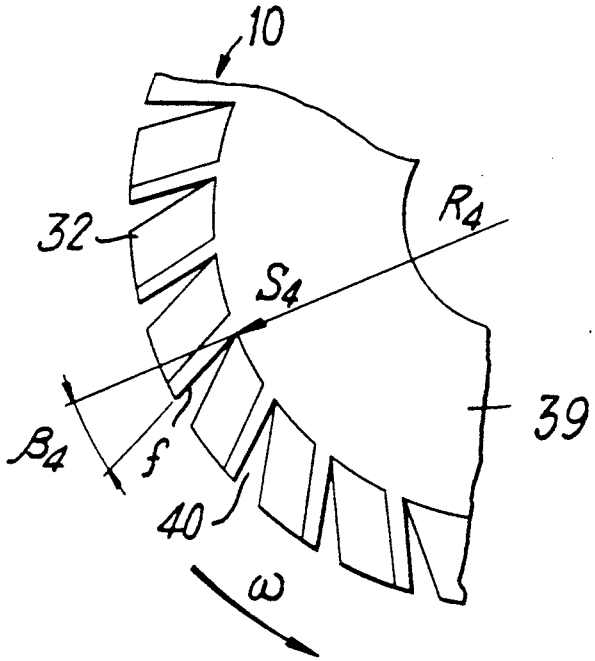
FIG. 6 is a view taken along the arrow A in FIG. 2 showing a portion of the fourth bladed wheel at the gas suction side.

Each blade 30 (FIGS. 2, 8) of the second bladed wheel 8 at the gas suction side V is arranged so that, if ignoring the thickness of the blade, the line "n" of intersection of its planes with the plane K perpendicular to the axis O of rotation of the rotor 3 passing through the midsection of the bladed wheel 8 are arranged radially. The angles $\beta$ of inclination of the lines of intersection of the planes of the blade 30 with other planes perpendicular to the axis of rotation of the rotor 3 are relatively small and increase as the distance from the plane K increases. In addition, the lines "n" of intersection of the planes of the blade 30 with the planes disposed at different sides of the plane K are directed to the opposite sides of the respective radii $R_2$ of the hub 35.

Each blade 31 (FIG. 5) of the third bladed wheel 9 at the gas suction side V or second bladed wheel at the gas pressure side N is arranged so that the line "p" of intersection of one of its planes with the end surface of the bladed wheel 9 facing the gas suction side V is at an acute angle $\beta_3=20°$ to the radius $R_3$ of the hub 37 drawn to the point $S_3$ of intersection of the line "p" with the circle of the hub 37, and is inclined to the direction $\omega$ of rotation of the rotor 3.

Each blade 32 (FIG. 6) of the fourth bladed wheel 10 at the gas suction side V or of the first bladed wheel 10 at the gas pressure side N is arranged so that the line "f" of intersection of one of planes thereof with the end surface of the bladed wheel 10 facing the gas suction side V is at an acute angle $\beta_4=30°$ to the radius $R_4$ of the hub 39 drawn to the point $S_4$ of intersection of the line "f" with the circle of the hub 39 and inclined to the direction $\omega$ of rotation of the rotor 3. An increase in the distance from the plane K results in greater inclination angles of the line of intersection of the planes of the blades 29, 30, 31, 32. These angles can be as great as 60°. The maximum value of these angles depends on the angle $\alpha$ of inclination of the blades and preferred suction characteristics of the turbomolecular pump.

Figure 2:
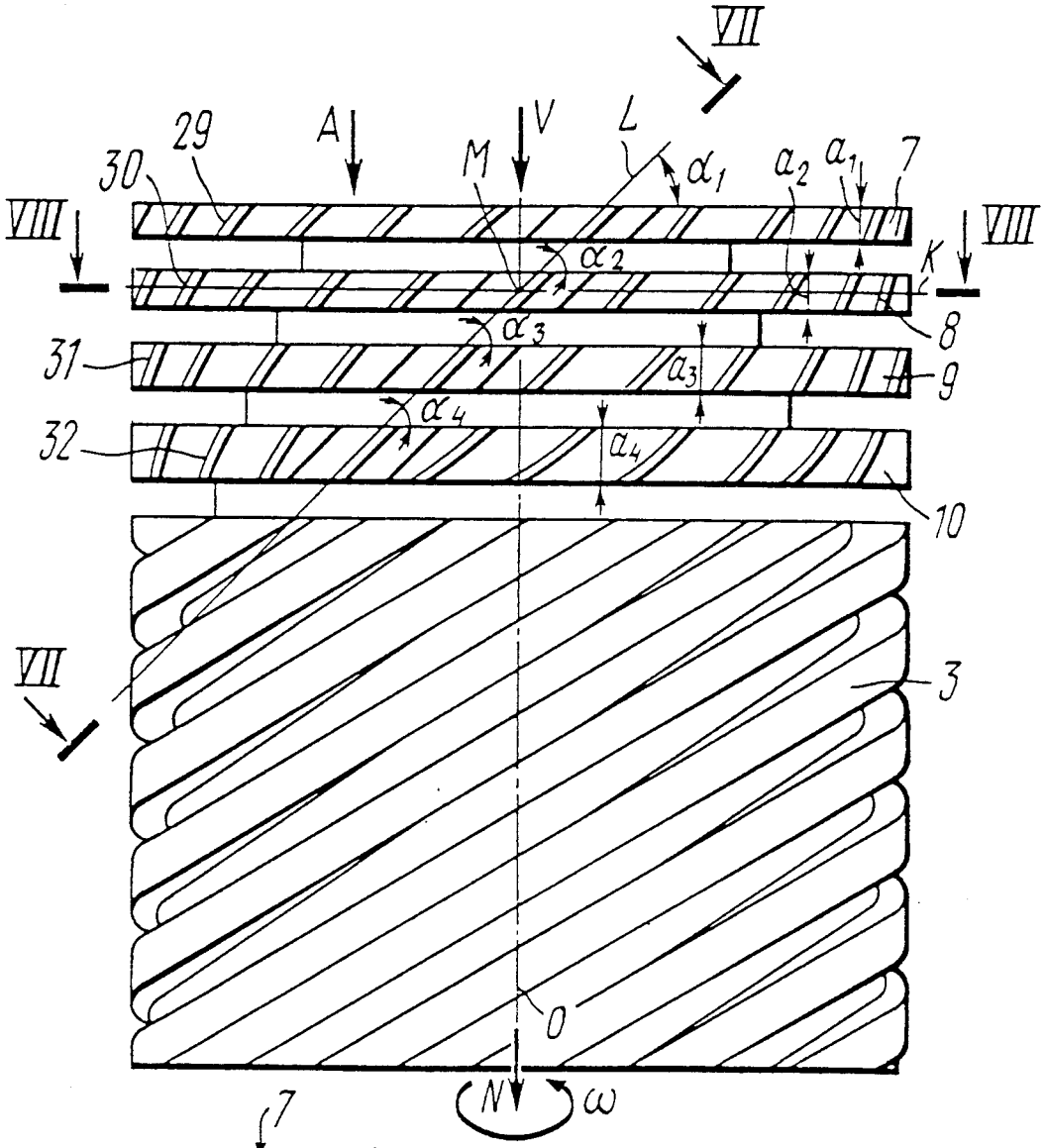
FIG. 2 is a view of a rotor of the proposed turbomolecular vacuum pump having four bladed wheels of the turbomolecular gas pumping stage and also having helical grooves of the molecular gas pumping stage.
Figure 3:
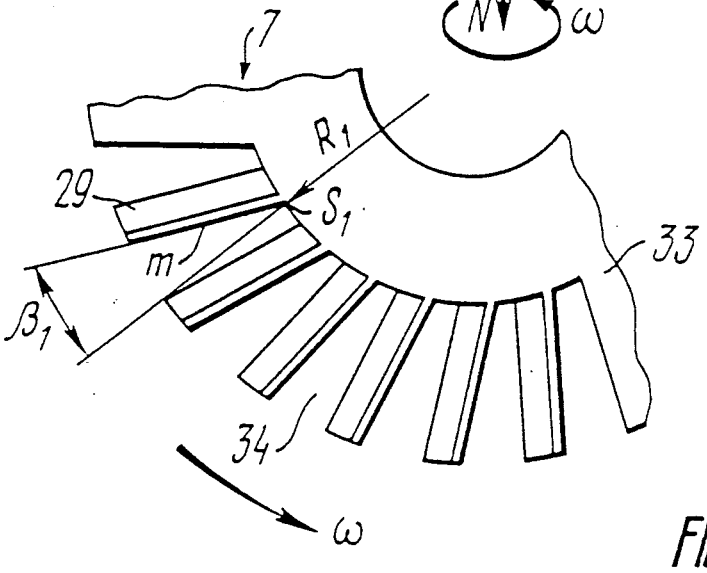
FIG. 3 is a view taken along the arrow A in FIG. 2 illustrating a portion of the first bladed wheel at the gas suction side.

In a modified form of the turbomolecular pump shown in FIG. 2 the plane K lies in the midsection of the second bladed wheel 8 the blades 30 of which are virtually radial, whereas the blades 29, 31, 32 of the other bladed wheels 7, 9, 10 resting at the opposite sides of the plane K are inclined to the opposite sides from the radial direction.

Location of this plane K in each specific construction of the turbomolecular vacuum pump is determined by calculations and depends on the required geometry of the bladed wheels, number of blades, flow section of the interblade passages, and angles $\alpha$ of inclination of the blades.

In the herein described embodiment all the bladed wheels 7, 8, 9, 10 are turned relative to one another about the axis O of rotation of the rotor 3 so that with respect to each bladed wheel 7, 8, 9, 10 there is one blade 29, 30, 31, 32 with which its planes facing one side lie in one plane L.

This arrangement of the turbomolecular vacuum pump allows fabrication of the rotor 3 as a single-piece unit, which substantially simplifies manufacture of the rotor 3, reduces the time required for its manufacture by a factor of 5, and results in a higher performance of the turbomolecular vacuum pump because the rotor 3 has no tendency of getting out of balance during operation.

The turbomolecular vacuum pump according to the invention operates in the following manner. The flange 28 (FIG. 1) of the pump is connected to a sealed chamber (not shown) of a production unit where vacuum is to be generated. The pipe butt 21 is connected to a pipeline (not shown) of forevacuum gas pumping. Forevacuum pumping of gas from the sealed chamber to a pressure of $1-10^{-1}$ Pa starts, after which a voltage is applied to the stator of the electric motor (not shown) to rotate the shaft 15 with rotor 3 thereby causing rotation of the bladed wheels 7, 8, 9, 10 in a direction indicated by $\omega$.

During rotation of the rotor 3 the molecules of gas present in the chamber being evacuated enter the pump interior to be caught by the blades 29 of the first bladed wheel 7 at the gas suction side V. Added to the inherent thermal velocity of the gas molecules is a velocity pulse obtained due to collision with the rotating blades 29. After multiple reflections from the blades 29 of the bladed wheel 7 the gas molecules collide with the bladed disk 11 and then with the blades 30 of the second bladed wheel 8. Gas molecules that follow the mirror law of reflection, moving in the planes tangent to circles coaxial with the hub circles and intersecting the planes of the blades 29 collide with the first bladed wheel 7 to obtain, apart from the tangential component force, a radial component force which promotes their travel to the periphery of the blades 29, where the linear velocity of the blades 29 is higher. Therefore, a higher impulse is imparted to the gas molecules for them to move faster from the gas suction side V to the gas pressure side N to result in a higher rapidity of the turbomolecular vacuum pump in operation. Having passed through the bladed disk 11, the gas molecules are acted upon by the second bladed wheel 8 the blades 30 of which have lines of intersection of their planes resting almost radially. As the gas molecules collide with the blades 30 of the bladed wheel 8, they obtain only a tangential component force, whereby the gas is pumped out substantially as in other known constructions of turbomolecular vacuum pumps. Subsequent to multiple reflections from the blades 30 of the bladed wheel 8 the molecules are brought in engagement with the bladed disk 12 and then with the bladed wheel 9 having lines "p" of intersection of the planes of the blades 31 thereof inclined toward the direction of rotation of the rotor 3. Gas molecules colliding with the side surface of blades 31 of the bladed wheel 9 receive an impulse directed from the periphery of the blades 9 to the axis 0 of rotation of the rotor 3 causing the gas molecules to move from the clearance 4 and reducing the backflow of dispersed gas molecules. Having passed the bladed wheel 9 the molecules are brought in engagement with the bladed disk 13 and further with the blades 32 of the bladed wheel 10. The bladed wheel 10 functions similarly to the bladed wheel 9. However, since $\beta_4 > \beta_3$, the molecules are evacuated from the clearance more efficiently thanks to reduced backflow of dispersed molecules in turn resulting in a higher gas compression ratio.

From the blades 32 of the bladed wheel 10 the gas molecules move to the slots 14 of the molecular gas pumping stage operating in the known manner.

In view of the aforedescribed, inclination of the lines of intersection of the blade planes from the radial direction to the direction of rotation of the rotor results in a higher gas compression ratio, whereas inclination thereof to the opposite direction leads to a higher rapidity. These factors ensure improved suction performance of the turbomolecular vacuum pump without enlarging its size.

The proposed turbomolecular vacuum pump can find application in a range of process units for generating and maintaining a vacuum with a residual gas pressure $10^{-1}$ to $10^{-7}$ Pa, such as in the electronic industry for making integrated circuits, growing artificial crystals, and in various research installations and devices, such as accelerators of elementary particles, mass spectrometers, electronic microscopes, etc., where vacuum is essential.

We claim:

1. A turbomolecular vacuum pump, comprising:

a stator having an axial hole;

a rotor, accommodated in the axial hole of the stator;

at least two bladed wheels, accommodated on the rotor and each having flat blades and a hub, the flat blades of the bladed wheels being spaced about a circumference of the hub, so that flow sections of adjacent passages formed between adjacent flat blades of the bladed wheels reduce in size from a bladed wheel at a gas suction side to a bladed wheel at a gas pressure side, planes of the flat blades of the bladed wheels being inclined, respective to planes drawn perpendicular to an axis of rotation of the rotor, in a direction of rotation of the rotor, lines of intersection being formed between the planes of the blade of the bladed wheels and the planes perpendicular to the axis of rotation of the rotor, the lines of intersection resting at an angle to radii of hubs of the bladed wheels, directed towards the direction of rotation of the rotor with respect to at least one bladed wheel at the gas pressure side, and directed away from the direction of rotation of the rotor with respect to at least one bladed wheel at the gas suction side; and bladed discs secured to the stator between the bladed wheels of the rotor, and having flat blades, the flat blades of the bladed discs being arranged at an angle to the flat blades of the bladed wheels.

* * * * *